US011377272B2

(12) United States Patent
Painchaud et al.

(10) Patent No.: US 11,377,272 B2
(45) Date of Patent: Jul. 5, 2022

(54) DEVICE FOR CLOSING A CONTAINER BY SCREWING, SECURED BY A RETRACTABLE LUG

(71) Applicant: Nemera La Verpillière S.A.S., La Verpilliere (FR)

(72) Inventors: Gaëtan Painchaud, Francheville (FR); Thierry Decock, Lyons (FR); Jose Camba, Amberieu en Bugey (FR)

(73) Assignee: Nemera La Verpillière

( * ) Notice: Subject to any disclaimer, the term of this patent is extended or adjusted under 35 U.S.C. 154(b) by 478 days.

(21) Appl. No.: 15/570,081

(22) PCT Filed: Apr. 25, 2016

(86) PCT No.: PCT/FR2016/050970
§ 371 (c)(1),
(2) Date: Oct. 27, 2017

(87) PCT Pub. No.: WO2016/174336
PCT Pub. Date: Nov. 3, 2016

(65) Prior Publication Data

US 2018/0127172 A1 May 10, 2018

(30) Foreign Application Priority Data

Apr. 28, 2015 (FR) ..... 1553788

(51) Int. Cl.
*B65D 50/04* (2006.01)
*A61J 1/14* (2006.01)

(52) U.S. Cl.
CPC ..... *B65D 50/046* (2013.01); *A61J 1/1418* (2015.05); *A61J 1/1475* (2013.01); *B65D 2215/02* (2013.01); *B65D 2543/00435* (2013.01)

(58) Field of Classification Search
CPC ..... A61J 1/1418; A61J 1/1412; B65D 41/04; B65D 50/046
See application file for complete search history.

(56) References Cited

U.S. PATENT DOCUMENTS 4,427,124 A * 1/1984 Marshall ..... B65D 83/0454 215/216
4,473,162 A * 9/1984 Donoghue ..... B65D 50/046 215/209

(Continued)

FOREIGN PATENT DOCUMENTS

CN 1384028 A 12/2002
CN 102596745 A 7/2012
CN 102656095 A 9/2012

*Primary Examiner* — Catharine L Anderson
*Assistant Examiner* — Arjuna P Chatrathi
(74) *Attorney, Agent, or Firm* — St. Onge Steward Johnston & Reens LLC

(57) ABSTRACT

A coupling member to be carried by a vessel of the container forming a vessel, and a cap intended to be screwed on the coupling member. The device also includes security features including a circumferential locking stop carried by the cap, and a complementary retractable circumferential locking stop carried by the coupling member. To this end, the coupling member includes a radial arm carrying a radial front arm, wherein the radial front arm and the radial arm extend in opposite directions. The front arm bears a lug forming the complementary retractable circumferential locking stop.

12 Claims, 3 Drawing Sheets

(56) References Cited

U.S. PATENT DOCUMENTS

| | | | | |
|---|---|---|---|---|
| 5,213,223 | A * | 5/1993 | Minnette | B65D 25/42 215/216 |
| 5,230,433 | A * | 7/1993 | Hamilton | B65D 50/046 215/221 |
| 5,711,442 | A * | 1/1998 | Kusz | B65D 50/046 215/209 |
| 5,899,348 | A | 5/1999 | Konefal et al. | |
| 6,076,689 | A * | 6/2000 | Vassallo | B65D 41/04 215/209 |
| 7,942,280 | B2 | 5/2011 | Priebe et al. | |
| 2006/0070970 | A1* | 4/2006 | Shingle | B65D 50/041 215/220 |
| 2006/0124501 | A1* | 6/2006 | McNeely | B65D 51/245 206/534 |
| 2009/0301985 | A1* | 12/2009 | Priebe | B65D 50/046 215/211 |
| 2010/0126955 | A1* | 5/2010 | Robinson | B65D 50/046 215/216 |
| 2012/0018318 | A1* | 1/2012 | Otsuka | A61J 1/1418 206/216 |
| 2013/0313254 | A1 | 11/2013 | Miceli et al. | |
| 2014/0284299 | A1 | 9/2014 | Barber et al. | |

* cited by examiner

DEVICE FOR CLOSING A CONTAINER BY SCREWING, SECURED BY A RETRACTABLE LUG

FIELD OF THE INVENTION

The present invention relates to a closure device intended to be borne by a tank-forming container. The container is for example intended to receive a pharmaceutical product in fluid form and can be provided with a dispensing pump, possibly metered.

BACKGROUND OF THE INVENTION

As is known, the market offers pharmaceutical products sold in flasks comprising, more often than not, a tank-forming container onto which is added a dispensing end-fitting forming, for example, a metering pump.

Conventionally, the dispensing end-fitting is protected by a closure device comprising a cap intended to be fitted onto the container or be removed from this container by a movement of screwing/unscrewing the cap on the container.

With the regulations constantly changing, more and more countries are demanding that the pharmaceutical products in flasks put on sale in their territories have secured closure means, commonly called CRC, which stands for "child resistant closure packaging".

Such secured means provide for example for allowing the cap to be removed only by movements that are a priori not linked to one another.

Already proposed in the prior art, notably in U.S. Pat. No. 7,942,280, is a medical device, intended for example to contain pills sold by the unit, comprising such secured means. In the example considered, the medical device comprises a tank-forming container bearing a coupling part with outer threading onto which is screwed a cap with inner threading. The coupling part comprises a bridge to which is linked a lug preventing the untimely unscrewing of the cap. The bridge is deformable so as to allow the lug to be retracted axially when there is a desire to judiciously screw or unscrew the cap.

Such secured means are usually associated with a container of relatively large diameter because they are generally too bulky to be able to be associated with a container of relatively small diameter.

SUMMARY OF THE INVENTION

The aim of the invention is to propose a secured closing device suited to a container that can have, if necessary, a reduced diameter.

To this end, the subject of the invention is a closure device for a tank-forming container, of the type comprising:

- a coupling member comprising an outer threading and intended to be borne by the container,
- a cap comprising an inner threading and intended to be fitted onto the coupling member or to be removed from this coupling member by screwing or unscrewing,
- safety means comprising:
  - at least one circumferential locking abutment borne by the cap, and
  - at least one retractable complementary circumferential locking abutment borne by the coupling member, characterized in that the coupling member comprises:

- a body of generally annular form,
- a radial arm provided with a free end and a linking end with the body, the free end of the radial arm being able to be displaced according to at least one axial component by elastic deformation of this radial arm,
- a radial forearm provided with a free end and a linking end with the free end of the radial arm such that the radial forearm and the radial arm each extend from their linking end to their free end in opposite directions,
- a lug borne by the radial forearm, this lug forming the retractable complementary circumferential locking abutment.

Thus, to separate the cap from the coupling member, the user presses axially on the free end of the radial arm, generally with the thumb of a first hand which grasps the container, so as to provoke a flexing in an axial plane of this radial arm. Because of this flexing:

- the free end of the radial arm and the linking end of the radial forearm are displaced according to the combination:
  - of an axial movement of separation of the free end of the radial arm in relation to the cap, and
  - of a radial movement of convergence of the free end of the radial arm in relation to the cap, and
- the free end of the radial forearm bearing the lug is displaced according to the combination:
  - of an axial movement of separation or of convergence of the free end of the radial forearm in relation to the cap, and
  - of a radial movement of separation of the free end of the radial arm in relation to the cap, this radial separation movement scaled down by the presence of the radial forearm.

This allows the retraction of the complementary circumferential locking abutment borne by the coupling member. With his or her second hand, the user can then unscrew the cap by a standard motion. A child does not generally coordinate these two motions spontaneously, so that the closure of the container is secured effectively with respect to accidental handling by a child.

Through their opposite directions, the radial arm and the radial forearm linked together constitute circumferentially less bulky means that are therefore suited to containers of relatively small diameters. The particular configuration of the radial arm and of the radial forearm makes it possible, compared to the known devices, to one and the same axial stressing by the user, to scale down the radial releasing of the lug.

The invention can also comprise the following optional features.

Advantageously, the radial arm is generally U-shaped, the free end of the radial arm and the linking end of the forearm forming the web of the U.

In this way, the device offers the user a comfortable bearing surface for exerting the pressure which provokes the flexing of the radial arm, and in a manner relatively independent of the radial dimensions of the coupling member and of the cap and without the user having to exert an excessive force.

Advantageously, the lug extends axially from the radial forearm in a direction opposite to that of the axial displacement of the plug when it is screwed onto the coupling member.

Preferentially, the circumferential width of the lug increases in the direction of the radial displacement of the plug when it is screwed onto the coupling member.

Such a profile makes it possible to reduce the contact zones and therefore friction zones between the cap and the lug when the cap is screwed onto the coupling member.

Advantageously, the retractable complementary circumferential locking abutment borne by the coupling member delimits a straight edge substantially parallel to the axial component of the screwing or unscrewing of the cap on the coupling member.

The circumferential locking abutment borne by the cap can form a circumferential end of an indentation, or of a notch, formed in the cap.

Preferentially, the cap comprises an edge delimiting an open end of this cap, this edge being delimited by an outline forming an outer cam profile intended to cooperate, during the screwing or the unscrewing of the cap, with the lug to displace, or hold in its retracted position, the retractable complementary circumferential locking abutment borne by the coupling member.

The lug can comprise at least one radially internal chamfer to facilitate the cooperation with the cam profile-forming outline of the cap.

Another subject of the invention is a medical device comprising a container and a closure device for this container, characterized in that the closure device is according to the invention.

The medical device according to the invention can also comprise the following optional features:

- the container comprises a tank having a neck and the coupling member is mounted to rotate freely about the neck of the tank;
- the container comprises a tank having a neck and the coupling member is made of a single piece with the tank of the container;
- the container comprises a tank having a neck and the coupling member is mounted on the tank by screwing.

In the case where the coupling member is mounted to rotate freely about the neck of the tank, any attempt to unscrew the cap without prior radial retraction of the locking tab provokes a rotation of all of the closure device about the neck of the container, reducing the risk of application of inappropriate efforts on the locking tab and the circumferential locking abutment.

BRIEF DESCRIPTION OF THE DRAWINGS

The invention will be better understood on reading the following description, given purely as an example and with reference to the attached figures, in which.

DETAILED DESCRIPTION OF THE INVENTION

Figures 1, 2, 3, 4:
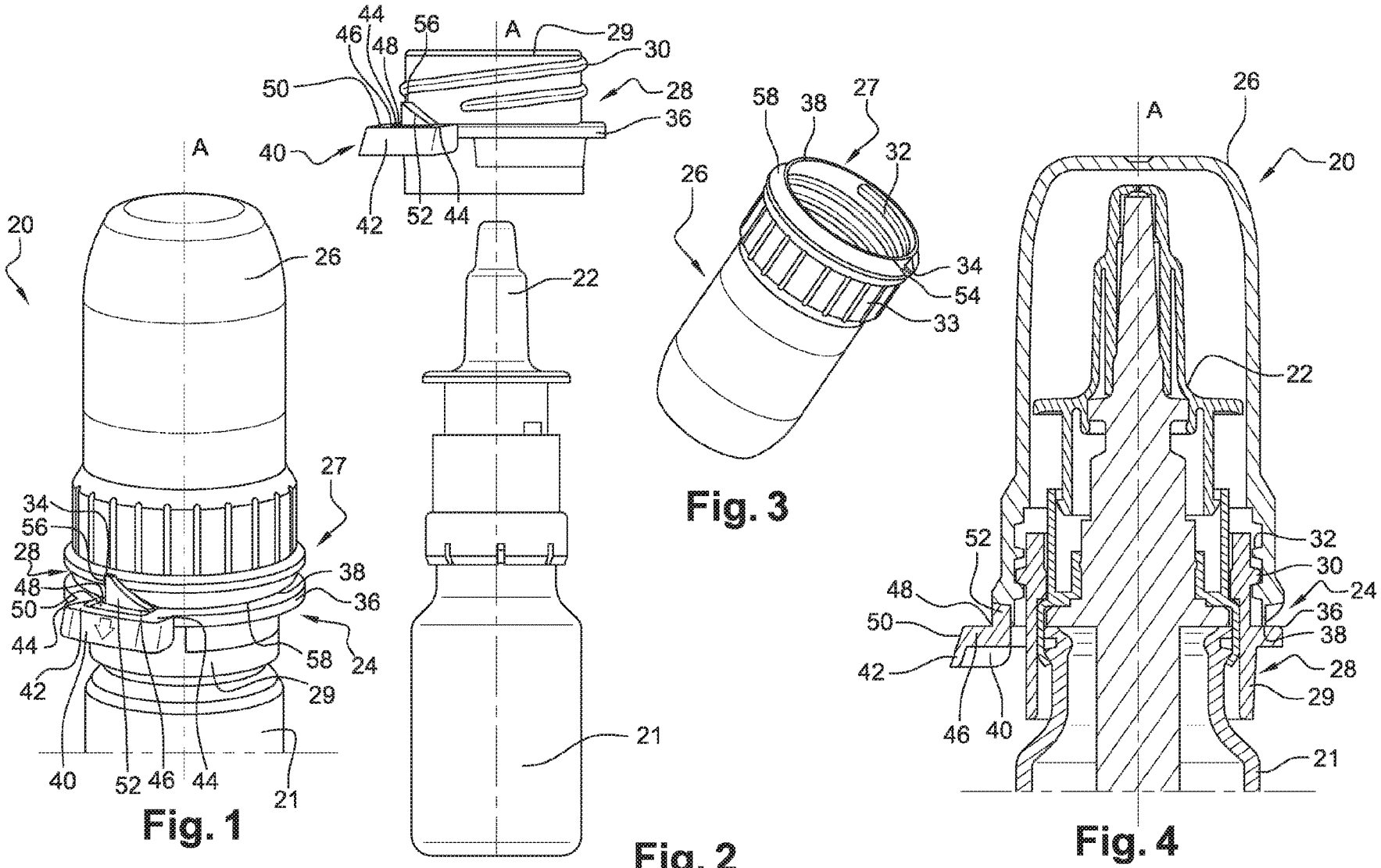
FIG. 1 is partial perspective view of a medical device comprising a closure device provided with a cap in screwed position, according to a first embodiment of the invention.
FIG. 2 is an exploded view showing a part of the elements of the medical device of FIG. 1.
FIG. 3 is a perspective view of the cap of the medical device of FIG. 1.
FIG. 4 is a partial view in axial cross section of the medical device of FIG. 1.

Reference is now made to FIGS. 1 and 2. In these figures a medical device 20 according to the invention is represented. This medical device 20 comprises a tank-forming container 21 of general form of revolution about an axis A.

Hereinbelow, any reference to an axial direction will be made with reference to the axis A.

This tank 21 comprises a neck onto which is added an end-fitting 22 for dispensing a product contained in the tank 21. As a variant, this dispensing end-fitting 22 could be made of a single piece with the neck of the tank 21.

The medical device 20 also comprises a closure device 24 for the tank 21.

This closure device 24 comprises a cap 26 comprising an open end 27 and a coupling member 28 comprising a body 29 of generally ring-forming annular form.

As can be seen in FIG. 2, the coupling member 28 is intended to be borne by the neck of the container 21. In the embodiment described, the coupling member 28 is mounted to rotate freely about the neck of the tank 21.

As a variant, the coupling member 28 could be made of a single piece with the tank 21.

The container 21 and the coupling member 28 are for example produced in polypropylene (PP). The cap 26 is for example produced in polypropylene (PP) or in high-density polyethylene (HDPE).

The body 29 of the coupling member 28 comprises an outer threading 30 intended to cooperate with an inner threading 32 of the cap 26 (see FIG. 3). These outer 30 and inner 32 threadings make it possible to fit the cap 26 onto the coupling member 28 by screwing or remove the cap 26 from the coupling member 28 by unscrewing. Preferably, the cap 26 comprises an annular gripping zone 33, comprising axial grooves, for example evenly distributed over the circumference of the cap 26, on which a user can place his or her fingers to screw or unscrew the cap 26.

As can be seen in FIG. 3, an indentation 34 is formed in the open end 27 of the cap 26.

The body 29 of the coupling member 28 comprises, after the outer threading 30 considering the axial direction of screwing, a flange 36 forming an end-of-screwing travel abutment. As can be seen in FIG. 4 in particular, this end-of-screwing travel abutment is intended to cooperate with a complementary surface 38 formed by the edge of the cap 26 delimiting the open end 27 thereof.

As can be seen in FIGS. 1 and 2, the flange 36 of the coupling member 28 is prolonged by a radial arm 40 having a general U shape. This radial arm 40 is provided with a free end 42 and two linking ends 44 with the body 29 of the coupling member 28.

Moreover, as can be seen in FIGS. 1 and 4, the radial arm 40 is prolonged by a radial forearm 46. This radial forearm 46 is provided with a free end 48 and a linking end 50 with the free end 42 of the radial arm 40. In this way, the radial forearm 46 and the radial arm 40 each extend from their linking end 44, 50 to their free end 42, 48 in opposite directions. It will be noted that the web of the U is formed by the free end 42 of the radial arm 40 and by the linking end 50 of the radial forearm 46.

The free end 42 of the radial arm 40 can be displaced according to at least one axial component (parallel to the axis A) by elastic deformation of this radial arm 40.

In the embodiment described, and as can be seen in FIGS. 1, 2 and 4, the radial forearm 46 bears, on its free end 48, a lug 52.

This lug 52 extends from the radial forearm 46 axially (parallel to the axis A) in a direction opposite to that of the axial displacement of the cap 26 when it is screwed onto the coupling member 28. The circumferential width of this lug 52 increases in the direction of axial displacement of the cap 26 when it is screwed onto the coupling member 28. Thus, the lug 52 is circumferentially wider at its linking end with the radial forearm 46 than at its free end. In the example illustrated, the lug 52 has a triangular form whose height increases in the direction of unscrewing of the cap 26.

Moreover, to protect the medical device 20 against untimely opening, in particular by a child, the closure device 24 comprises safety means. These safety means comprise:

- a circumferential locking abutment 54 borne by the cap 26 (see FIG. 3), and
- a retractable complementary circumferential locking abutment 56 borne by the coupling member 28 (see FIGS. 1 and 2).

The circumferential locking abutment 54 borne by the cap 26 forms a circumferential end of the indentation 34 formed in the open end 27 of the cap 26. As a variant, provision could be made for this circumferential locking abutment 54 to form a circumferential end of a notch.

The lug 52 forms the retractable complementary circumferential locking abutment 56. In effect, the retractable complementary circumferential locking abutment 56 borne by the coupling member 28 delimits a straight edge of the lug 52. This straight edge is substantially parallel to the axial component (parallel to the axis A) of the screwing or unscrewing of the cap 26 on the coupling member 28.

This retractable complementary circumferential locking abutment 56 can be retracted by displacement of the free end 42 of the radial arm 40 according to at least one axial component (parallel to the axis A) by elastic deformation.

When the cap 26 is in screwed position, the retractable complementary circumferential locking abutment 56 formed by the lug 52 of the coupling member 28 cooperates with the circumferential locking abutment 54 of the indentation 34 of the cap 26.

Figure 5:
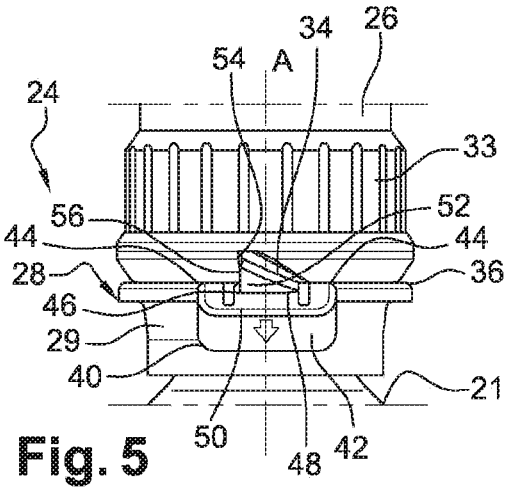
FIG. 5 is a partial view in elevation of the medical device of FIG. 1, the complementary circumferential abutment borne by the coupling member being in retracted position.

In the embodiment described and as can be seen in FIGS. 1 and 5, the indentation 34 formed in the cap 26 has a form substantially similar to that of the lug 52 in order to facilitate the fitting of the lug 52 into the indentation 34. Thus, in the example illustrated, the retractable complementary circumferential locking abutment 56 has a triangular form complementing that of the lug 52.

Moreover, the edge of the cap 26 delimiting its open end 27 is delimited by an outline forming an outer cam profile 58. This outline 58 is intended to cooperate, in the screwing or the unscrewing of the cap 26, with the lug 52 to displace, or hold in its retracted position, the retractable complementary circumferential locking abutment 56 borne by the coupling member 28.

To this end, the lug 52 can comprise a radially inner chamfer to facilitate the cooperation with the cam profile-forming outline 58 of the cap 26.

The main steps in handling the medical device 20 according to the invention are described hereinbelow.

Consider first of all the medical device 20 in closed configuration, as represented in FIG. 1. A user wanting to open the medical device 20 must, as can be seen in FIG. 5, exert a pressure on the free end 42 of the radial arm 40 to provoke a flexing in an axial plane of this radial arm 40, by elastic deformation, toward the tank 21. This pressure can for example be exerted by the thumb.

Because of this flexing, the free end 42 of the radial arm 40 and the linking end 50 of the radial forearm 46 are displaced according to the combination:

- of an axial movement of separation of the free end 42 of the radial arm 40 in relation to the cap 26, and
- of a radial movement of convergence of the free end 42 of the radial arm 40 in relation to the cap 26.

Moreover, the free end 48 of the radial forearm 46 bearing the lug 52 is displaced according to the combination:

- of an axial movement of separation of the free end 48 of the radial forearm 46 in relation to the cap 26, and
- of a radial movement of separation of the free end 42 of the radial arm 40 in relation to the cap 26.

The latter radial separation movement is scaled down by the presence of the radial forearm 46.

Thus, when the free end 42 of the radial arm 40 is displaced toward the tank 21, it drives the linking end 50 of the radial forearm 46 with it. Now, the radial forearm 46 is not deformed and its free end 44 is thus raised axially (parallel to the axis A) in the direction of unscrewing of the cap 26. The lug 52 is displaced thereby out of the indentation 34 formed in the cap 26. Thus, the retractable complementary circumferential locking abutment 56 borne by the lug 52 of the coupling member 28 is retracted and it no longer cooperates with the circumferential locking abutment 54 borne by the cap 26.

Figure 6:
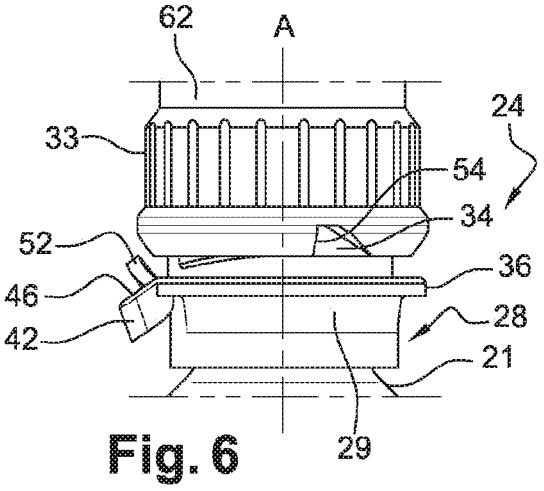
FIG. 6 is a partial view in elevation of the medical device of FIG. 1 during unscrewing, the complementary circumferential abutment borne by the coupling member being in retracted position.
Figure 7:
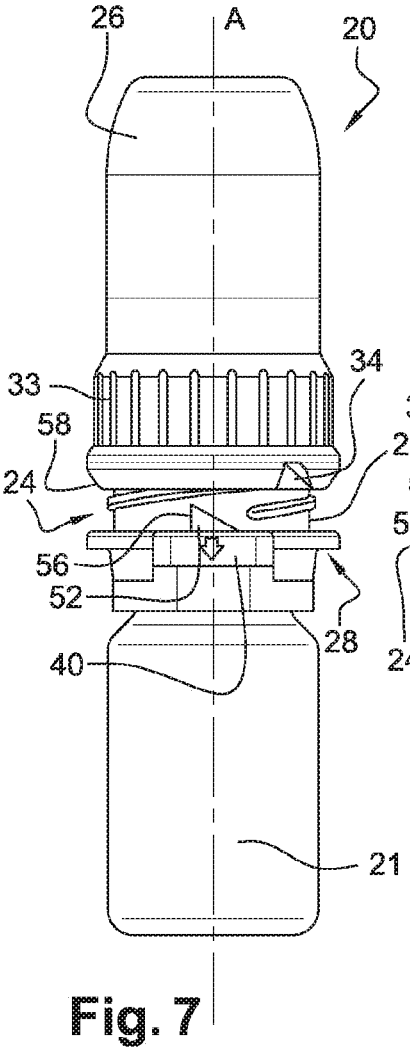
FIG. 7 is a view in elevation of the medical device of FIG. 1, the cap being at the start of screwing.
Figure 8:
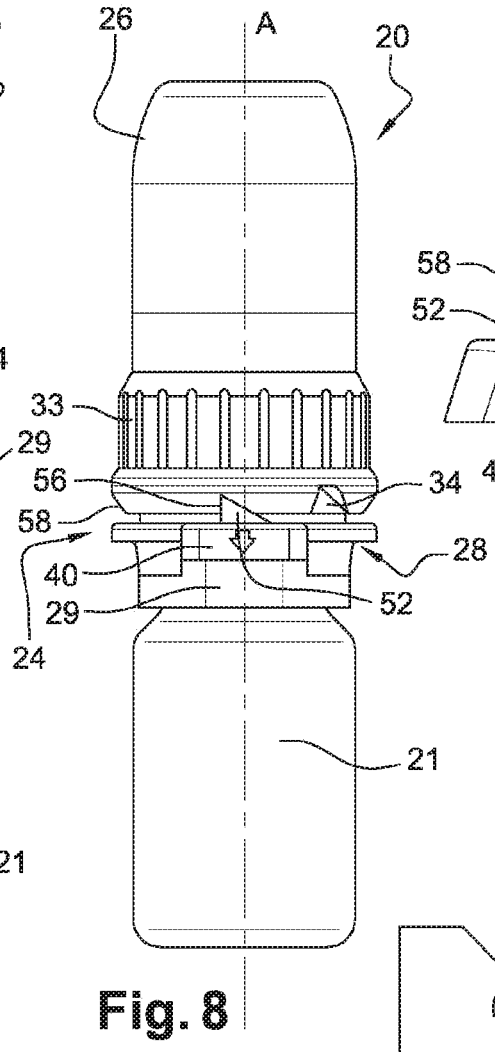
FIG. 8 is a view similar to FIG. 7, the screwing having advanced.
Figure 9:
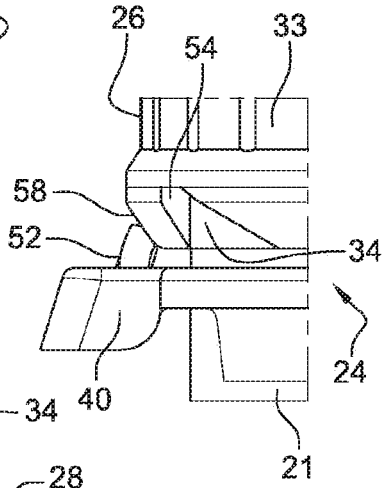
FIG. 9 is a view similar to FIGS. 5 and 6, the screwing being almost finished.

The user can then, as illustrated in FIG. 6, unscrew the cap 26 by a standard motion.

During the unscrewing, the outline 58 of the cap 26 cooperates with the lug 52 to hold the retractable complementary circumferential locking abutment 56 in its retracted position throughout the operation.

To screw the cap 26 onto the coupling member 28, the user performs a standard screwing motion. When the cap 26 is axially close enough to the free end of the lug 52 for the edge of the open end 27 of the cap 26 to enter into contact therewith, the cam profile-forming outline 58 cooperates with the lug 52 and allows the retraction of the retractable complementary circumferential locking abutment 56 formed by the lug 52. Thus, the screwing continues conventionally until the complementary surface 38 formed by the edge of the cap 26 delimiting the open end 27 thereof cooperates by abutment with the end-of-screwing travel flange 36. The lug 52 is then located facing the indentation 34 formed in the cap 26 and reverts to its position of rest. Thus, the circumferential locking abutment 54 borne by the cap 26 and the retractable complementary circumferential locking abutment 56 borne by the coupling member 28 cooperate once again and prevent any untimely unscrewing of the cap 26.

The invention is not limited to the embodiments presented and other embodiments will become clearly apparent to a person skilled in the art. It is in particular possible to provide for the lug 52 to be placed between the linking end 44 and the free end 42 of the radial arm 40.

Figure 10:
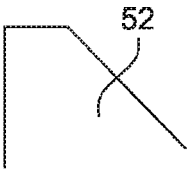
FIGS. 10 and 11 are profile diagrams of possible lugs.
Figure 11:
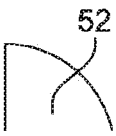

It is also possible, as can be seen in FIGS. 10 and 11, to give different forms to the lug 52. In effect, in FIG. 10, the lug 52 has its tip cut off so that it is less fragile. In FIG. 11, the lug 52 has a rounded edge which facilitates the cooperation with the cap 26 during the screwing.

Figure 12:
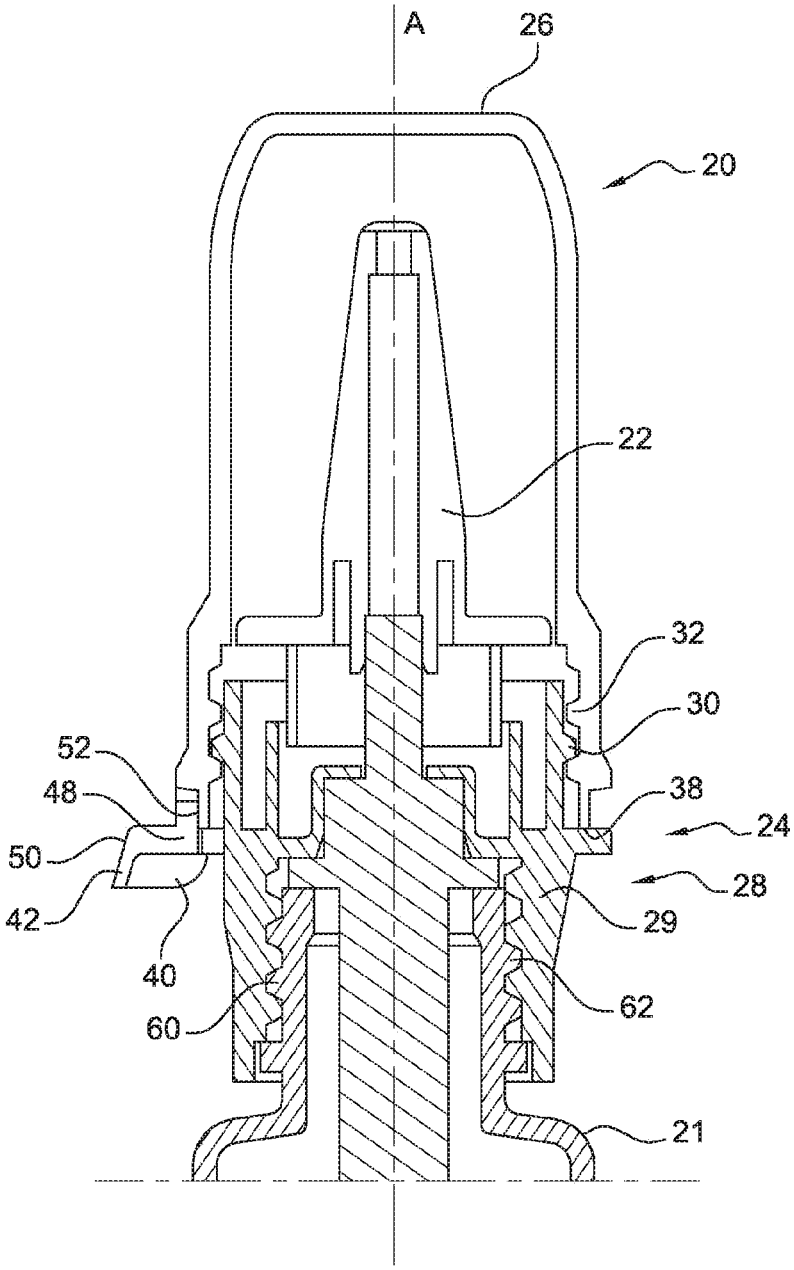
FIG. 12 is a view in cross section similar to FIG. 4 of a medical device comprising a closure device according to a second embodiment of the invention.

Below is a description, with reference to FIG. 12, of a medical device 20 according to a second embodiment of the invention. In this case, the elements similar to those of the preceding figures are denoted by identical references.

In this embodiment, the closure device 24 is mounted on the tank 21 by screwing. The means for screwing the closure device 24 onto the tank 21 comprise first 60 and second 62 threadings formed respectively on the tank 21 and on the closure device 24.

The invention claimed is:

1. A closure device for a tank-forming container, of the type comprising:

a coupling member comprising an outer threading and intended to be borne by the container, a cap comprising an inner threading and intended to be fitted onto the coupling member or to be removed from this coupling member by screwing or unscrewing, safety features comprising:

at least one circumferential locking abutment borne by the cap, and at least one retractable complementary circumferential locking abutment borne by the coupling member, characterized in that the coupling member comprises:

a body of generally annular form, a radial arm provided with a free end and a linking end with the body, the free end of the radial arm being able to be displaced according to at least one axial component by elastic deformation of this radial arm, a radial forearm provided with a free end and a linking end with the free end of the radial arm such that the radial forearm and the radial arm each extend from their linking end to their free end in opposite directions, a lug borne by the radial forearm, this lug forming the retractable complementary circumferential locking abutment, wherein the lug extends axially from the radial forearm in a direction opposite to that of the axial displacement of the cap when it is screwed onto the coupling member;

wherein the radial forearm extends mainly radially from its linking end to its free end; and in which the cap comprises an edge delimiting an open end of said cap, said edge being delimited by an outline forming an outer cam profile of said cap configured to cooperate, during the screwing or the unscrewing of the cap, with the lug to displace or hold in its retracted position the retractable complementary circumferential locking abutment borne by the coupling member.

2. The closure device according to claim 1, in which the radial arm is generally U-shaped, the free end of the radial arm and the linking end of the radial forearm forming the web of the U.

3. The closure device according to claim 1, in which the circumferential width of the lug increases in the direction of the axial displacement of the cap when it is screwed onto the coupling member.

4. The closure device according to claim 1, in which the retractable complementary circumferential locking abutment borne by the coupling member delimits a straight edge substantially parallel to the axial component of the screwing or unscrewing of the cap on the coupling member.

5. The closure device according to claim 1, in which the circumferential locking abutment borne by the cap forms a circumferential end of an indentation, or of a notch, formed in the cap.

6. A medical device comprising a container and a closure device for this container, characterized in that the closure device is according to claim 1.

7. The medical device according to claim 6, in which the container comprises a tank having a neck and in which the coupling member is mounted to rotate freely about the neck of the tank.

8. The medical device according to claim 6, in which the container comprises a tank having a neck and in which the coupling member is made of a single piece with the tank of the container.

9. The medical device according to claim 6, in which the container comprises a tank having a neck and in which the coupling member is mounted on the tank by screwing.

10. The closure device according to claim 3, in which the retractable complementary circumferential locking abutment borne by the coupling member delimits a straight edge substantially parallel to the axial component of the screwing or unscrewing of the cap on the coupling member.

11. The closure device according to claim 10, in which the circumferential locking abutment borne by the cap forms a circumferential end of an indentation, or of a notch, formed in the cap.

12. The closure device according to claim 11, in which the cap comprises an edge delimiting an open end of this cap, this edge being delimited by an outline forming an outer cam profile intended to cooperate, during the screwing or the unscrewing of the cap, with the lug to displace, or hold in its retracted position, the retractable complementary circumferential locking abutment borne by the coupling member.

* * * * *